US011774138B2

(12) United States Patent
Kondo et al.

(10) Patent No.: US 11,774,138 B2
(45) Date of Patent: Oct. 3, 2023

(54) HOT WATER DEVICE

(71) Applicant: NORITZ CORPORATION, Hyogo (JP)

(72) Inventors: Masaki Kondo, Hyogo (JP); Norihide Wada, Hyogo (JP)

(73) Assignee: NORITZ CORPORATION, Hyogo (JP)

( * ) Notice: Subject to any disclaimer, the term of this patent is extended or adjusted under 35 U.S.C. 154(b) by 339 days.

(21) Appl. No.: 17/275,173

(22) PCT Filed: Aug. 22, 2019

(86) PCT No.: PCT/JP2019/032779

§ 371 (c)(1),
(2) Date: Mar. 10, 2021

(87) PCT Pub. No.: WO2020/066385

PCT Pub. Date: Apr. 2, 2020

(65) Prior Publication Data

US 2021/0325083 A1 Oct. 21, 2021

(30) Foreign Application Priority Data

Sep. 26, 2018 (JP) ..... 2018-180338

(51) Int. Cl.

| | |
|---|---|
| ***F24H 1/00*** | (2022.01) |
| ***F28F 9/00*** | (2006.01) |
| ***F24H 1/10*** | (2022.01) |

(52) U.S. Cl.

CPC ..... *F24H 1/0036* (2013.01); *F28F 9/002* (2013.01); *F24H 1/107* (2013.01); *F28F 2230/00* (2013.01); *F28F 2275/06* (2013.01)

(58) Field of Classification Search

CPC ..... F24H 1/0036; F24H 1/41; F28F 2275/06–068

See application file for complete search history.

(56) References Cited

U.S. PATENT DOCUMENTS 5,347,958 A * 9/1994 Gordon, Jr. ..... F28D 21/0007 110/162
2018/0224337 A1* 8/2018 Nagasaka ..... F24H 9/146

FOREIGN PATENT DOCUMENTS

JP S4728244 11/1972
JP S57132774 8/1982
(Continued)

OTHER PUBLICATIONS

Kim, Translation and originial of KR20010000164 (Year: 2001).*
(Continued)

*Primary Examiner* — Steven S Anderson, II
(74) *Attorney, Agent, or Firm* — JCIPRNET

(57) ABSTRACT

A hot water device includes a heat exchanger and an apparatus to which the heat exchanger is to be connected. First and second cases for the heat exchanger and the apparatus to which the heat exchanger is to be connected include first and second flange portions laid over each other and welded together. The first and second flange portions are each demarcated into a corner flange portion corresponding to one of first and second corner portions, and into a non-corner flange portion other than the corner flange portion. The non-corner flange portions protrude more to the outside of the first and second cases than the corner flange portions.

4 Claims, 6 Drawing Sheets

(56) References Cited

FOREIGN PATENT DOCUMENTS

| | | | | |
|---|---|---|---|---|
| JP | S6311752 | | | 1/1988 |
| JP | S6366749 | | | 5/1988 |
| JP | H0611192 | | | 1/1994 |
| JP | H07239094 | | | 9/1995 |
| JP | 2003279286 | | | 10/2003 |
| JP | 2012241955 | | | 12/2012 |
| JP | 2017009231 | | | 1/2017 |
| KR | 20010000164 | A | * | 1/2001 |
| WO | 2018037857 | | | 3/2018 |

OTHER PUBLICATIONS

"International Search Report (Form PCT/ISA/210) of PCT/JP2019/032779," dated Nov. 12, 2019, with English translation thereof, pp. 1-4.

* cited by examiner

HOT WATER DEVICE

CROSS-REFERENCE TO RELATED APPLICATION

This application is a 371 application of the International PCT application serial no. PCT/JP2019/032779, filed on Aug. 22, 2019, which claims the priority benefits of Japan Patent Application No. 2018-180338, filed on Sep. 26, 2018. The entirety of each of the above-mentioned patent applications is hereby incorporated by reference herein and made a part of this specification.

BACKGROUND

Technical Field

The present invention relates to a hot water device such as a hot water supply device or the like which includes a heat exchanger.

Related Art

As the hot water device, there is a device including a heat exchanger in which a heat transfer tube with water flowing inside is accommodated in a case. When this heat exchanger is connected to a desired apparatus to be connected to (for example, another heat exchanger or a burner case of a combustion device), a flange connection mechanism is often employed (for example, see Patent literature 1). In the flange connection mechanism, each of a case of the heat exchanger and a case of the apparatus to be connected to is equipped with a flange portion, and these flange portions are overlapped and bonded with each other. The bonding is realized by, for example, welding. According to this configuration, connection strength between the heat exchanger and the apparatus to be connected to can be improved. An airtightness of the connection location of the flange portion can also be improved.

However, in the conventional technique described above, there is still room for improvement as described below.

That is, when each case of the heat exchanger and the apparatus to be connected to is manufactured, the number of the constituent components thereof is desired to be reduced and a manufacturing cost is desired to be lowered. Therefore, a mechanism is often employed in which a metal plate which is a raw material of the case is bent and a plurality of side wall portions of the case are connected via corner portions. In the mechanism, before the metal plate is bent, a flange portion is bent and formed previously on the metal plate, and when the metal plate is bent to form the corner portion, the flange portion is also bent at the same time. Therefore, if a protrusion dimension of the flange portion is large, the bending process for forming the corner portion on the metal plate becomes difficult. In addition to this, there is a possibility that a damage such as cracking or the like may occur at a location of the flange portion corresponding to the corner portion. On the other hand, if the protrusion dimension of the flange portion is reduced in order to solve this problem, the heat capacity of the flange portion is reduced. In addition, during the welding, cooling using chill blocks also becomes difficult. Thus, there is a possibility that when the welding is performed in the flange portion, a temperature of the flange portion may become abnormally high, which causes a welding defect.

LITERATURE OF RELATED ART

Patent Literature

Patent literature 1: Japanese Patent Laid-Open No. 2012-241955

Patent literature 2: Japanese Utility Model Laid-Open No. 63-66749

Patent literature 3: International Publication No. WO 2018/037857

SUMMARY

Problems to be Solved

An object of the present invention is to provide a hot water device capable of appropriately preventing or suppressing the above-described problems.

Means to Solve Problems

In order to solve the problems described above, a following technical mechanism is taken in the present invention.

A hot water device provided by the present invention includes: a heat exchanger having a first case, wherein the first case includes a plurality of first side wall portions connected via at least one first corner portion, and first flange portions protruding to an outside of the first case in a form bent from the plurality of first side wall portions; and an apparatus to which the heat exchanger is to be connected having a second case, wherein the second case includes a plurality of second side wall portions connected via at least one second corner portion, and second flange portions protruding to an outside of the second case in a form bent from the plurality of second side wall portions. The first flange portions and the second flange portions are laid over each other and welded together, the first flange portions and the second flange portions are each demarcated into a corner flange portion corresponding to the first corner portion and the second corner portion, and into a non-corner flange portion other than the corner flange portion, and the non-corner flange portions protrude more to the outside of the first case and the second case than the corner flange portions.

Preferably, the corner flange portion has a curved portion which is curved in a plan view in a manner of corresponding to a bending shape of the first corner portion and the second corner portion, and a pair of straight portions which is non-curved in a plan view, is connected to both ends of the curved portion, and has a protrusion dimension towards the outside of the first case and the second case which is the same as a protrusion dimension of the curved portion.

Preferably, a boundary region between the corner flange portion and the non-corner flange portion is an inclined region in which a front end portion of the inclined region is inclined in a manner that the more a part of the non-corner flange portion approaches the corner flange portion from the non-corner flange portion the less a protrusion dimension towards the outside of the first case and the second case.

Preferably, the first case includes a first case main body portion in which the plurality of first side wall portions are connected in a Π-shape in a plan view so as to form a first side surface opening portion, and a first side plate portion which is bonded to the first case main body portion so as to close the first side surface opening portion. The second case includes a second case main body portion in which the plurality of second side wall portions are connected in a Π-shape in a plan view so as to form a second side surface opening portion, and a second side plate portion which is bonded to the second case main body portion so as to close the second side surface opening portion. The first flange portion and the second flange portion are arranged in the first case main body portion and the second case main body portion. The first side plate portion and the second side plate portion include a third flange portion and a fourth flange portion laid over each other and welded together.

Preferably, the hot water device according to the present invention further includes: a case corner welding portion in which a first case corner portion and a second case corner portion are welded to each other, wherein in the first case corner, the first flange portion and the third flange portion are adjacent to each other, and in the second case corner portion, the second flange portion and the fourth flange portion are adjacent to each other. At each end portion of the first to fourth flange portions, an inclined portion is formed in which a front end portion of the inclined portion is inclined in a manner that the more a part approaches the case corner welding portion the less a protrusion dimension towards the outside of the case.

Preferably, the first case main body portion and the second case main body portion further include a first longitudinal flange portion and a second longitudinal flange portion which extend in a vertical height direction of the first case main body portion and the second case main body portion and are abutted and bonded to the first side plate portion and the second side plate portion. In a part of the first and second longitudinal flange portions and the first and second side plate portions which is close to the case corner welding portion, an additional inclined portion is formed in which a front end portion of the additional inclined portion is inclined in a manner that as the more a part approaches the case corner welding portion the less a protrusion dimension towards the outside of the case.

Preferably, the heat exchanger is a primary heat exchanger which collects heat from a heating gas, and the apparatus to be connected to is a secondary heat exchanger which further collects heat from a heating gas that has passed through the primary heat exchanger.

Other features and advantages of the present invention will be more apparent from the following description of an embodiment of the invention with reference to accompanying drawings.

DESCRIPTION OF THE EMBODIMENTS

A preferable embodiment of the present invention is specifically described below with reference to drawings.

Figure 2:
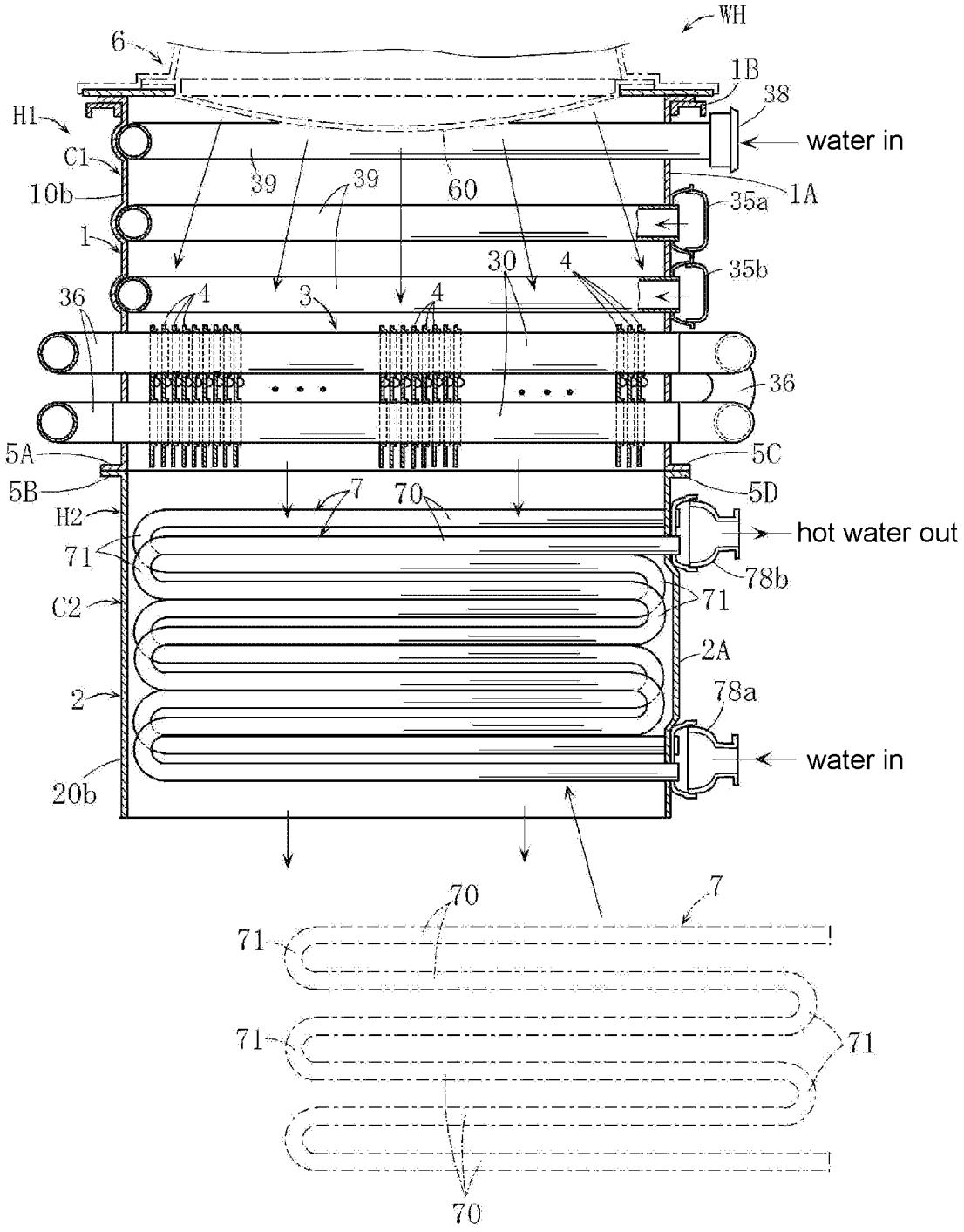
FIG. 2 shows an example of the hot water device according to the present invention and corresponds to a cross-sectional view along a line II-II of FIG. 1.

A hot water device WH shown in FIG. 2 includes a burner 6 partially shown by virtual lines, a primary heat exchanger H1, and a secondary heat exchanger H2. The hot water device WH also includes first to fourth flange portions 5A to 5D as mechanisms for connecting the primary heat exchanger H1 and the secondary heat exchanger H2. Although the description is omitted, below the secondary heat exchanger H2, for example, an exhaust collection cylinder or the like for exhausting a combustion gas (an exhaust gas) after heat recovery to the outside is arranged. The primary heat exchanger H1 corresponds to an example of a "heat exchanger" in the present invention, and the secondary heat exchanger H2 corresponds to an example of an "apparatus to be connected to" in the present invention.

The burner 6 is of a so-called reverse combustion type known conventionally. In the burner 6, a fuel gas is mixed with combustion air discharged from a fan (not shown), and the air-fuel mixture is injected into the primary heat exchanger H1 via an air-fuel mixture injection member 60 having air permeability. The air-fuel mixture is ignited, and the combustion gas used as a heating gas is supplied into the primary heat exchanger H1.

The primary heat exchanger H1 includes a first case C1, a heat transfer tube 3 accommodated inside the first case C1, a plurality of fins 4 for heat absorption, a plurality of body pipes 39, and a plurality of header portions 35*a* and 35*b* connecting the plurality of body pipes 39 to each other. The body pipes 39 are arranged along inner surfaces of a plurality of side wall portions (first side wall portions) 10*a* to 10*c* of the first case C1, and play a role of absorbing heat for heating water and cooling the plurality of side wall portions 10*a* to 10*c* of the first case C1.

Figure 1:
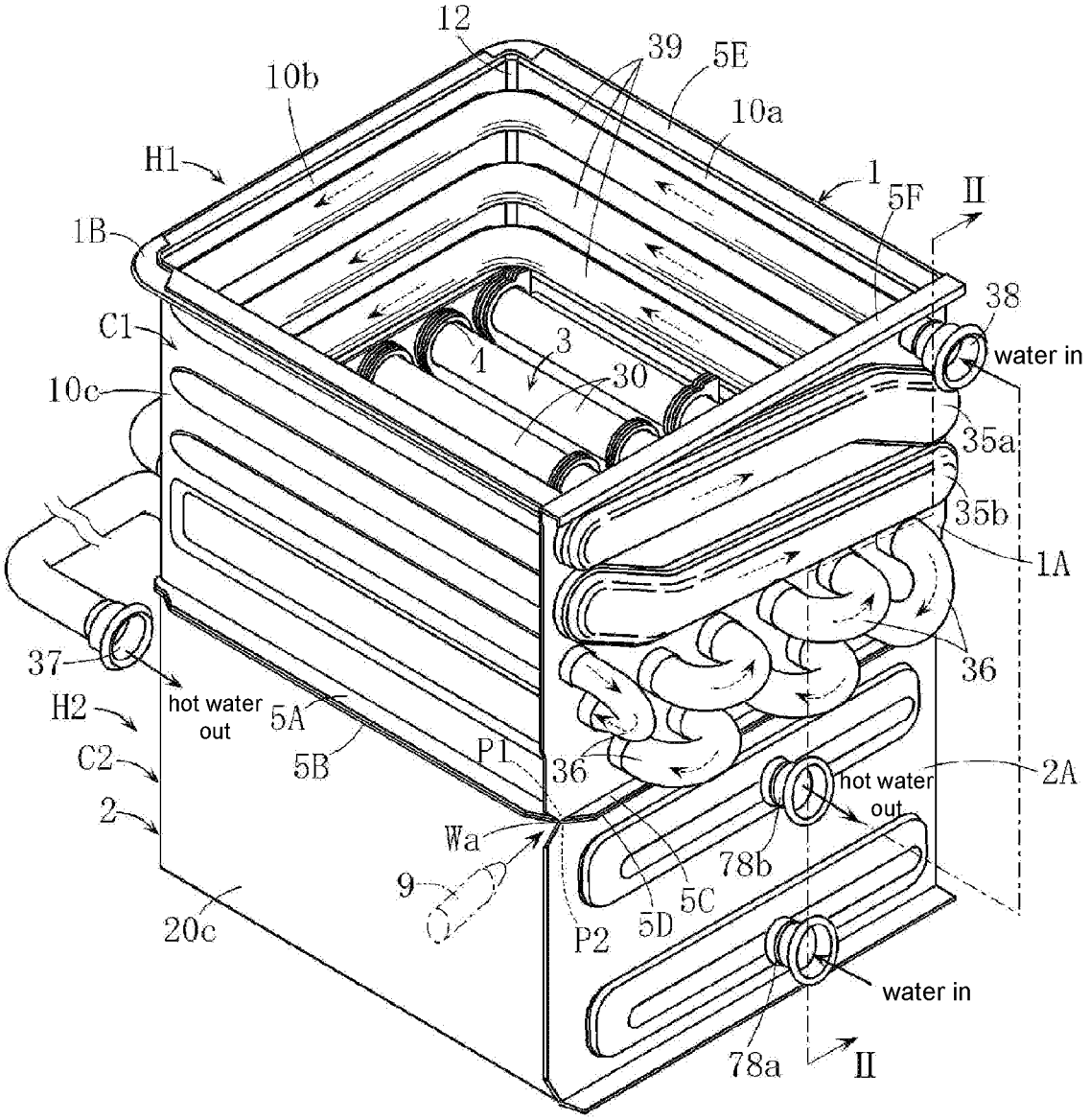
FIG. 1 is a perspective view of a connected state of a primary heat exchanger (a heat exchanger) and a secondary heat exchanger (an apparatus to be connected to) which serve as constituent elements of a hot water device according to the present invention.

As shown by break-line arrows in FIG. 1, the water supplied to a water inlet 38 of the body pipe 39 flows into the heat transfer tube 3 after passing through the body pipes 39 and the plurality of header portions 35*a* and 35*b*, and then reaches a hot water outlet 37. The heat transfer tube 3 has a configuration in which a plurality of straight tube body portions 30, which are arranged laterally and disposed vertically and horizontally in the first case C1, are connected in a series via a plurality of bend tubes 36.

The secondary heat exchanger H2 includes a second case C2 and a plurality of heat transfer tubes 7 accommodated inside the second case C2. The heat transfer tube 7 is, for example, a meandering heat transfer tube which is obtained in a manner that a plurality of straight tube body portions 70 disposed at intervals in a vertical height direction are connected in a series via connection tube body portions 71 having a semi-circular arc shape or the like. The plurality of heat transfer tubes 7 are disposed in a width direction of the second case C2 (a direction orthogonal to the paper surface of FIG. 2), and are arranged in a staggered arrangement in a manner that heights of the heat transfer tubes 7 adjacent to each other are different from each other. Header portions 78*a* and 78*b* for entering water and discharging hot water are attached to end portions of the plurality of heat transfer tubes 7, and the water supplied to the header portion 78*a* for entering water passes through the plurality of heat transfer tubes 7 and then reaches the header portion 78*b* for discharging hot water. The water which has reached the header portion 78*b* is sent to the water inlet 38 of the primary heat exchanger H1.

Figure 3:
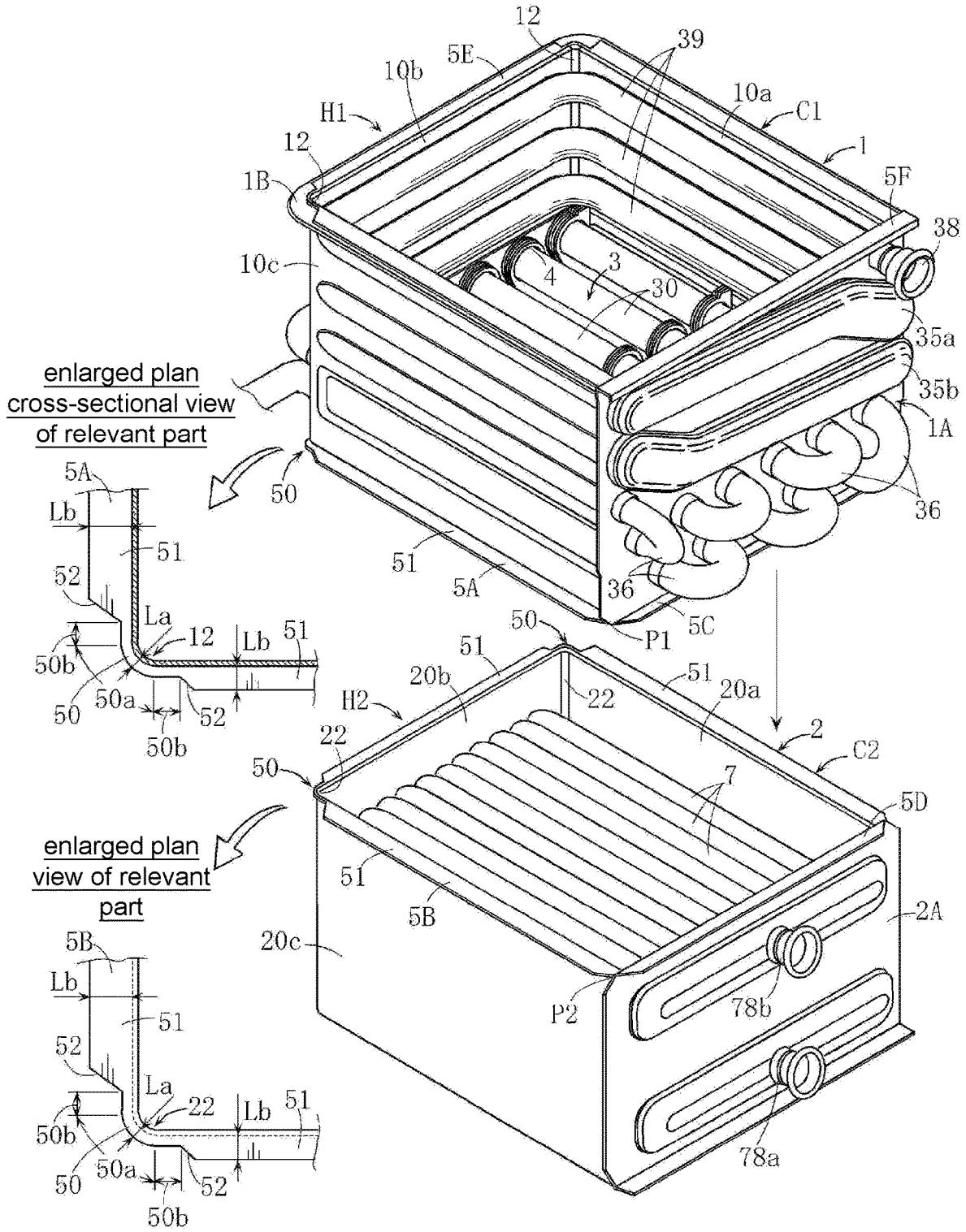
FIG. 3 is an exploded perspective view of FIG. 1.
Figure 4:
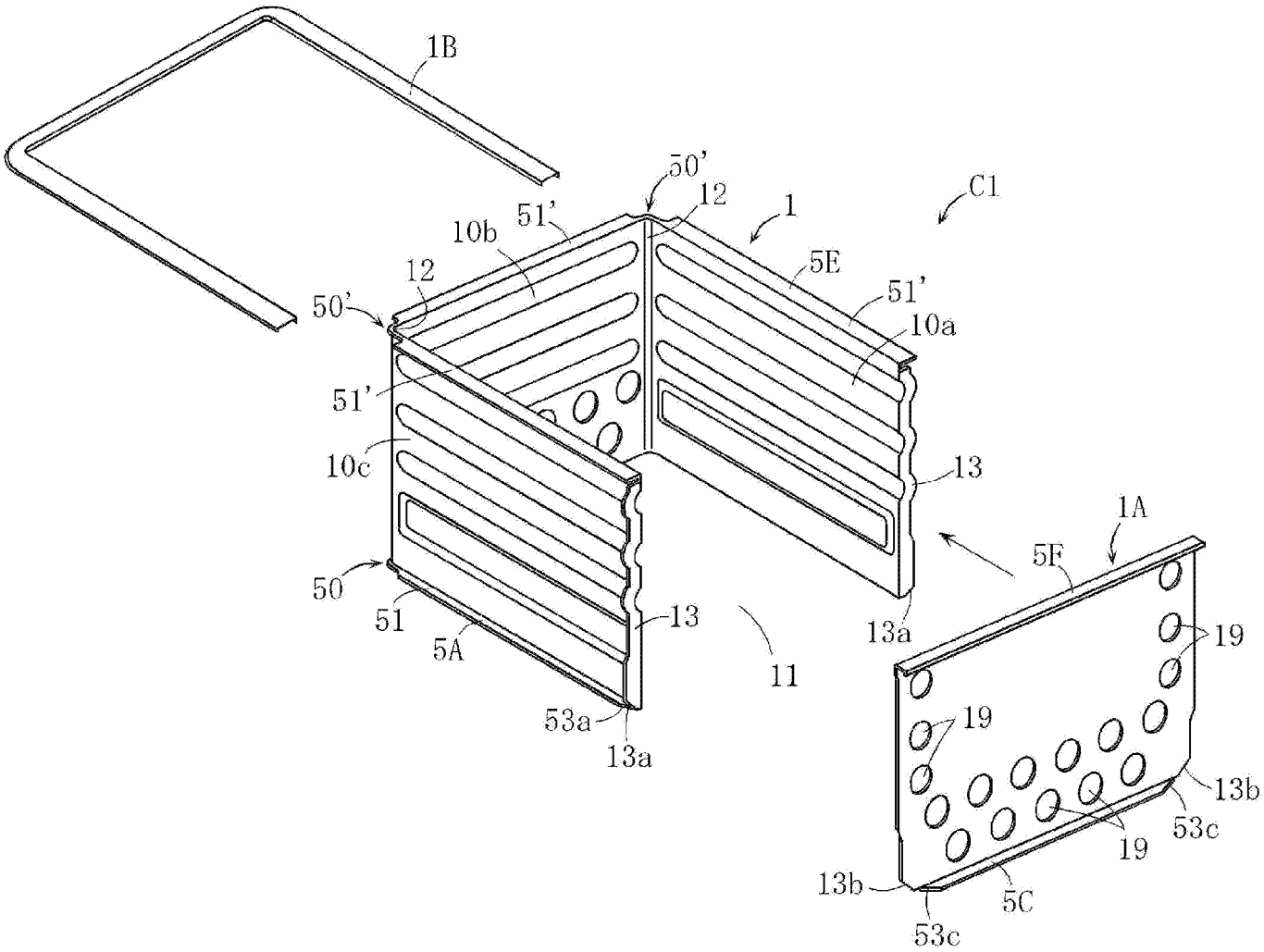
FIG. 4 is an exploded perspective view of a first case of the primary heat exchanger shown in FIG. 1.
Figure 5:
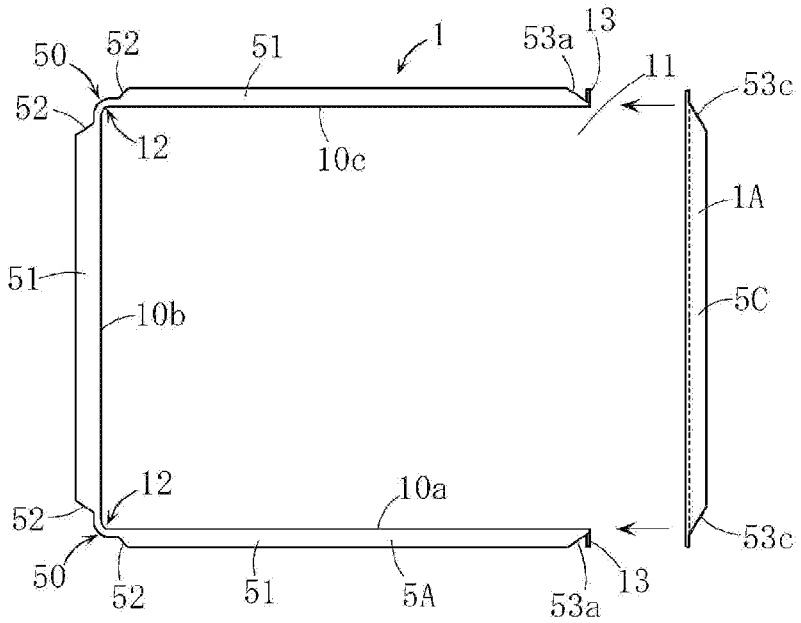
FIG. 5 is a bottom view of a first case main body portion and a first side plate portion configuring the first case shown in FIG. 4.

The first case C1 has a rectangular tubular shape in which both upper and lower surface portions are open, and as shown in FIGS. 3 to 5, the first case C1 includes a first case main body portion 1 which has a Π-shape in a plan view and forms a first side surface opening portion 11, a first side plate portion 1A bonded to the first case main body portion 1 so as to close the first side surface opening portion 11, and an auxiliary member 1B. A specific mechanism for bonding the first case main body portion 1 and the first side plate portion 1A is not particularly limited, and in addition to the welding, a mechanism such as brazing or the like can also be employed (the mechanism for bonding a second case main body portion 2 and a second side plate portion 2A described later is also the same). In the first side plate portion 1A, the header portions 35*a* and 35*b* (omitted in FIG. 4 and FIG. 5) are arranged, and a plurality of hole portions 19 are arranged through which end portions of the plurality of straight tube body portions 30 of the heat transfer tube 3 are inserted. The first case main body portion 1 is formed by bending a metal plate and has three side wall portions 10*a* to 10*c* connected via two first corner portions 12. A first flange portion 5A is arranged at lower end portions of these side wall portions 10*a* to 10*c*.

The first flange portion 5A has a Π-shape in a plan view, which is the same as the plurality of side wall portions 10*a* to 10*c*, and the first flange portion 5A is demarcated into a corner flange portion 50 protruding to the outside of the case from each first corner portion 12 at the lower end portions of the first case C1, and into a non-corner flange portion 51 protruding to the outside of the case from a part different from the first corner portion 12. A protrusion dimension Lb of the non-corner flange portion 51 to the outside of the case is relatively large, whereas a protrusion dimension La of the corner flange portion 50 to the outside of the case is smaller than the protrusion dimension Lb.

As clearly shown in an enlarged plan cross-sectional view of a relevant part in FIG. 3, preferably, the corner flange portion 50 has a configuration in which straight portions 50*b* are connected to both ends of a curved portion 50*a* which is curved in a plan view in a manner of corresponding to a bending shape of the first corner portion 12. The straight portion 50*b* is a part which is non-curved in a plan view and has a protrusion dimension towards the outside of the case the same as a protrusion dimension of the curved portion 50*a*, and a length of the straight portion 50*b* is relatively short. A boundary region between the corner flange portion 50 and the non-corner flange portion 51 in the first flange portion 5A is an inclined region 52 in which a front end portion is inclined in a manner that a protrusion dimension towards the outside of the case is reduced as a part approaches the corner flange portion 50 from the non-corner flange portion 51.

A third flange portion 5C is arranged at a lower end portion of the first side plate portion 1A. The third flange portion 5C is arranged by bending the lower end portion of the first side plate portion 1A to the outside of the case. Downward surfaces of the first and third flange portions 5A and 5C are surfaces that are bonded facing second and fourth flange portions 5B and 5D described later, and the downward surfaces are set to a flush height.

Fifth and sixth flange portions 5E and 5F are arranged at each upper end portion of the first case main body portion 1 and the first side plate portion 1A. The fifth and sixth flange portions 5E and 5F are portions used to mount and connect the burner 6 on the primary heat exchanger H1. In the embodiment, the flange connection mechanism that the present invention intends is not employed for the connection between the primary heat exchanger H1 and the burner 6. However, unlike the embodiment, the flange connection mechanism that the present invention intends can also be employed. The fifth flange portion 5E has the same shape in a plan view as the first flange portion 5A and has a corner flange portion 50' and a non-corner flange portion 51' having the same configurations as the corner flange portion 50 and the non-corner flange portion 51 in the first flange portion 5A. An auxiliary member 1B having a Π-shape in a plan view is bonded to a back surface side of the fifth flange portion 5E to reinforce the fifth flange portion 5E.

Figure 6:
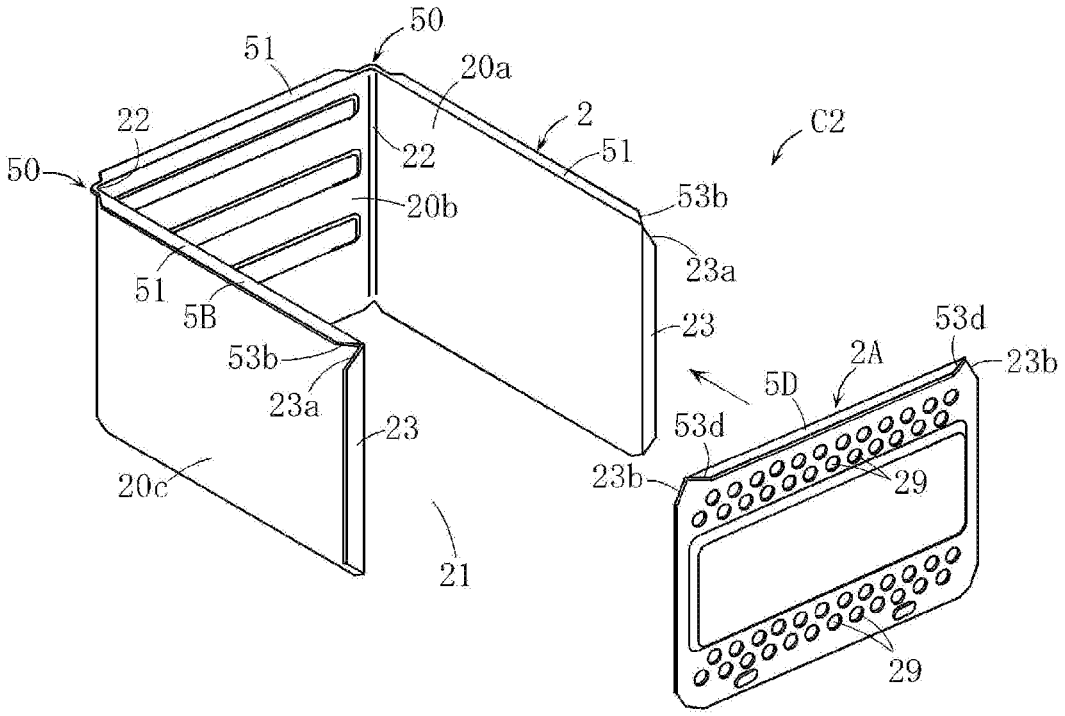
FIG. 6 is an exploded perspective view of a second case of the secondary heat exchanger shown in FIG. 1.

As shown in FIG. 3 and FIG. 6, the second case C2 is configured by combining a second case main body portion 2 and a second side plate portion 2A. Similar to the first case main body portion 1, the second case main body portion 2 has a Π-shape in a plan view and has three side wall portions (second side wall portions) 20*a* to 20*c* connected via two second corner portions 22. The second side plate portion 2A has a plurality of hole portions 29 through which the end portions of the plurality of heat transfer tubes 7 are inserted, and is bonded to the second case main body portion 2 so as to close a second side surface opening portion 21 of the second case main body portion 2.

The second and fourth flange portions 5B and 5D are arranged at upper end portions of the second case main body portion 2 and the second side plate portion 2A. The second flange portion 5B has the same shape in a plan view as the first flange portion 5A and has, the same as the first flange portion 5A, a corner flange portion 50 and a non-corner flange portion 51. Portions among each portion of the second flange portion 5B which are common to the first flange portion 5A are designated by the same reference signs as each portion of the first flange portion 5A, and the detailed description thereof is omitted. The fourth flange portion 5D is arranged by bending an upper end of the second side plate portion 2A to the outside of the case.

The first and second flange portions 5A and 5B are laid over each other, the third and fourth flange portions 5C and 5D are laid over each other, and edge welding is performed on the first and second flange portions 5A and 5B and the third and fourth flange portions 5C and 5D.

Moreover, the flange portion is not arranged at a lower end portion of the second case main body portion 2. However, alternatively, when a flange portion is also arranged at the lower end portion of the second case main body portion 2, this flange portion is expected to have the same configuration as the first and second flange portions 5A and 5B.

As clearly shown in FIG. 3, the first case C1 includes a first case corner portion P1 in which the end portions of the first and third flange portions 5A and 5C are adjacent to each other. The second case C2 includes a second case corner portion P2 in which the end portions of the second and fourth flange portions 5B and 5D are adjacent to each other. In the embodiment, as clearly shown in FIG. 8, as a mechanism for bonding the primary heat exchanger H1 and the secondary heat exchanger H2, a case corner welding portion Wa is also arranged in which the first and second case corner portions P1 and P2 are welded together.

At each end portion of the first to fourth flange portions 5A to 5D which is near the case corner welding portion Wa, inclined portions 53*a* to 53*d* are formed in which front end portions are inclined in a manner that the protrusion dimension towards the outside of the case is reduced as a part approaches the case corner welding portion Wa. At front end portions of the first and second case main body portions 1 and 2, first and second longitudinal flange portions 13 and 23 are arranged which extend in a vertical height direction and are abut against and bonded to the first and second side plate portions 1A and 1B. Here, additional inclined portions 13*a* and 23*a* are formed at a lower part or an upper part of the first and second longitudinal flange portions 13 and 23 which is near the case corner welding portion Wa. The first and second side plate portions 1A and 2A have a form in which both end portions thereof in the lateral width direction protruding out of the case from the first and second case main body portions 1 and 2, and additional inclined portions 13*b* and 23*b* are formed at a lower part or an upper part of the first and second side plate portions 1A and 2A which is near the case corner welding portion Wa.

Similar to the inclined portions 53*a* to 53*d*, the additional inclined portions 13*a*, 13*b*, 23*a*, and 23*b* are parts in which front end portions are inclined in a manner that the protrusion dimension towards the outside of the case is reduced as a part approaches to the case corner welding portion Wa. According to this configuration, the inclined portions 53*a* to 53*d* and the additional inclined portions 13*a*, 13*b*, 23*a*, and 23*b* have an outward expanding form centered on the case corner welding portion Wa. Therefore, when the welding work for arranging the case corner welding portion Wa is performed, for example, when a welding torch 9 is made to approach the portion to be welded, the first to fourth flange portions 5A to 5D, the first and second longitudinal flange portions 13 and 23, and the first and second side plate portions 1A and 1B can be prevented from becoming obstructions.

Next, an action of the above-described hot water device WH is described.

The first case main body portion 1 of the primary heat exchanger H1 is formed by bending the metal plate, in which the first flange portion 5A is formed previously, into a Π-shape in a plan view. Meanwhile, in the embodiment, the protrusion dimensions of the corner flange portions 50 and 50' are reduced, and thus the corner flange portions 50 and 50' do not become a large resistance in the work of bending the metal plate to form the first corner portion 12, and the work can be facilitated and smoothed. In addition, a large load can be prevented from being generated in the corner flange portions 50 and 50', and cracking can also be prevented from occurring in these parts. The corner flange portions 50 and 50' have a configuration in which the straight portions 50*b* are connected to both ends of the curved portion 50*a*, and a rapid shape change is avoided, and thus cracking can be more reliably prevented from occurring in these parts.

On the other hand, the second case main body portion 2 of the secondary heat exchanger H2 is formed by bending the metal plate, in which the second flange portion 5B is formed previously, into a Π-shape in a plan view. Meanwhile, the corner flange portion 50 of the second flange portion 5B has the reduced protrusion dimension and has the same configuration as the corner flange portions 50 and 50' of the first flange portion 5A. Therefore, the bending process is facilitated and smoothed, and problems such as cracking occurring in the corner flange portion 50 are also appropriately solved. Thus, reduction of a manufacturing cost of the first and second case main body portions 1 and 2 and the like can be achieved.

Figure 7A:
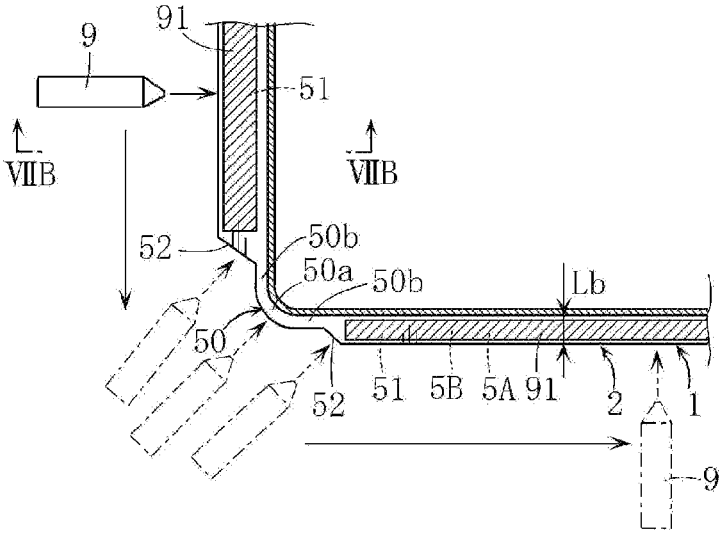
FIG. 7A is a plan cross-sectional view of a relevant part showing an example of a work of welding first and second flange portions of the primary heat exchanger and the secondary heat exchanger.
Figure 7B:
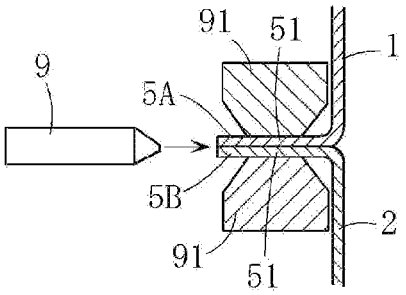
FIG. 7B is a cross-sectional view along a line VIIB-VIIB of FIG. 7A.

The edge welding of the first and second flange portions 5A and 5B can be performed, for example, in an aspect as shown in FIG. 7A and FIG. 7B. In the same diagrams, the pair of non-corner flange portions 51 is clamped by chill blocks 91 from above and below to be cooled. If the edge welding is performed in this aspect, the temperature of the first and second flange portions 5A and 5B are prevented from being abnormally high, and thus appropriate edge welding can be performed. Unlike the embodiment, when the entire first and second flange portions 5A and 5B are portions having a small protrusion dimension the same as the corner flange portion 50, the first and second flange portions 5A and 5B are difficult to be appropriately cooled by the chill blocks 91, but according to the embodiment, this difficulty can be overcome. Moreover, although the corner flange portion 50 is not directly cooled by the chill block 91, the temperature increase of the corner flange portion 50 can be appropriately suppressed by cooling the non-corner flange portion 51.

When the edge welding is performed on the first and second flange portions 5A and 5B, for example, as shown in FIG. 7A, the welding torch 9 will be moved. Meanwhile, the boundary region between the non-corner flange portion 51 and the corner flange portion 50 is the inclined region 52. Therefore, attitude control of setting the welding torch 9 in a direction suitable for welding the inclined region 52 becomes easy. As a result, the workability of the edge welding can also be improved.

Figure 8:
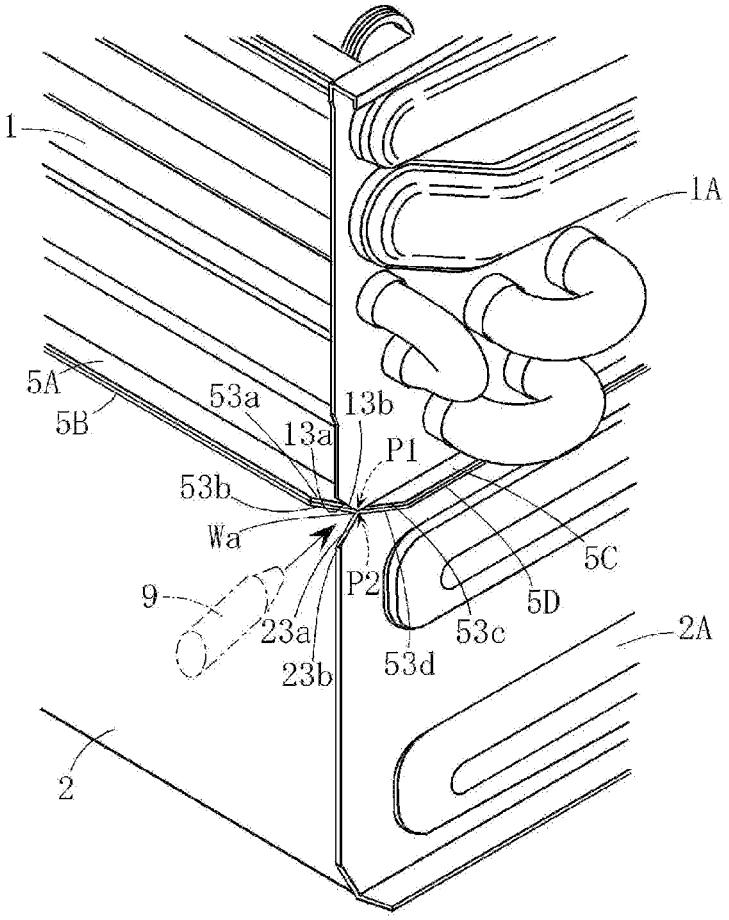
FIG. 8 is a perspective view of a relevant part showing an example of a work of welding predetermined locations of the primary heat exchanger and the secondary heat exchanger shown in FIG. 1.

As described with reference to FIG. 8, the first case corner portion P1 of the primary heat exchanger H1 and the second case corner portion P2 of the secondary heat exchanger H2 are welded to each other via the case corner welding portion Wa. Here, when the primary heat exchanger H1 and the secondary heat exchanger H2 are flange-connected, originally, a gap which causes a combustion gas leakage is likely to occur at a mutual position between the first and second case corner portions P1 and P2, but according to the embodiment, an unreasonable gap can also be prevented from being generated in the mutual position. In addition, as described above, in the embodiment, the inclined portions 53*a* to 53*d* and the additional inclined portions 13*a*, 13*b*, 23*a*, and 23*b* are arranged, and thereby the first to fourth flange portions 5A to 5D, the first and second longitudinal flange portions 13 and 23, and the first and second side plate portions 1A and 1B can be prevented from interfering with the welding work of the case corner welding portion Wa. As a result, the welding workability can be improved more. In addition, at the time of the welding, a welding rod can be easily set to the case corner welding portion Wa, and build-up welding becomes easy.

The present invention is not limited to the contents of the embodiment described above. The specific configuration of each portion of the hot water device according to the present invention can be variously and freely designed and changed within the scope that the present invention intends.

In the embodiment described above, the first and second cases C1 and C2 have the first and second case main body portions 1 and 2 which have the Π-shape in the plan view, and correspondingly, the first and second flange portions 5A and 5B also have the Π-shape in the plan view, but the present invention is not limited thereto. In the present invention, each of the first and second cases can also be formed in, for example, a rectangular tubular shape in which the three corner portions obtained by bending one metal plate are arranged, and the one corner portion is further arranged by bonding the both ends of the metal plate to each other. In this case, the first and second flange portions can also be formed in a rectangular frame shape covering the entire circumference of the outer periphery of the first and second cases having the rectangular tubular shape.

The first and second flange portions are configured in a manner that the protrusion dimension of the non-corner flange portion to the outside is larger than that of the corner flange portion, but the specific dimensions and the dimensional difference between the non-corner flange portion and the corner flange portion are not limited.

The welding of the first and second flange portions is not limited to the edge welding and can also be flip-chip bonding other than the edge welding, or welding other than the flip-chip bonding.

The heat exchanger in the present invention is not limited to the above-described primary heat exchanger H1 and can be a heat exchanger having a configuration other than the configuration of the primary heat exchanger H1.

The apparatus to be connected to in the present invention is not limited to the heat exchanger (the secondary heat exchanger). As the apparatus to be connected to, for example, an exhaust collecting cylinder (also including a simple duct and the like) for exhausting the gas passing through the heat exchanger, or a combustion device for supplying the combustion gas to the heat exchanger can also be applied.

What is claimed is:

1. A hot water device, comprising:

a heat exchanger comprising a first case, wherein the first case comprises a plurality of first side wall portions connected via at least one first corner portion, and first flange portions protruding to an outside of the first case in a form bent from the plurality of first side wall portions; and an apparatus to which the heat exchanger is to be connected comprising a second case, wherein the second case comprises a plurality of second side wall portions connected via at least one second corner portion, and second flange portions protruding to an outside of the second case in a form bent from the plurality of second side wall portions, wherein the first flange portions and the second flange portions are laid over each other and welded together, the first flange portions and the second flange portions are each demarcated into a corner flange portion corresponding to the first corner portion and the second corner portion, and into a non-corner flange portion other than the corner flange portion, and the non-corner flange portions protrude more to the outside of the first case and the second case than the corner flange portions, wherein the first case comprises a first case main body portion in which the plurality of first side wall portions are connected in a Π-shape in a plan view so as to form a first side surface opening portion, and a first side plate portion which is bonded to the first case main body portion so as to close the first side surface opening portion;

the second case comprises a second case main body portion in which the plurality of second side wall portions are connected in a Π-shape in a plan view so as to form a second side surface opening portion, and a second side plate portion which is bonded to the second case main body portion so as to close the second side surface opening portion;

the first flange portion and the second flange portion are arranged in the first case main body portion and the second case main body portion; and the first side plate portion and the second side plate portion comprise a third flange portion and a fourth flange portion laid over each other and welded together, wherein the hot water device further comprises:

a case corner welding portion in which a first case corner portion and a second case corner portion are welded to each other, wherein in the first case corner, the first flange portion and the third flange portion are adjacent to each other, and in the second case corner portion, the second flange portion and the fourth flange portion are adjacent to each other, wherein at each end portion of the first to fourth flange portions, an inclined portion is formed, and the more the inclined portion approaches the case corner welding portion the less a protrusion dimension towards the outside of the case, and wherein the first case main body portion and the second case main body portion further comprise a first longitudinal flange portion and a second longitudinal flange portion which extend in a vertical height direction of the first case main body portion and the second case main body portion and are abutted and bonded to the first side plate portion and the second side plate portion; and in a part of the first and second longitudinal flange portions and the first and second side plate portions which is close to the case corner welding portion, an additional inclined portion is formed in which a front end portion of the additional inclined portion is inclined in a manner that the more a part closer to the case corner welding portion the less a protrusion dimension towards the outside of the case.

2. The hot water device according to claim 1, wherein the corner flange portion comprises a curved portion which is curved in a plan view in a manner of corresponding to a bending shape of the first corner portion and the second corner portion, and a pair of straight portions which is non-curved in a plan view, is connected to both ends of the curved portion, and has a protrusion dimension towards the outside of the first case and the second case which is the same as a protrusion dimension of the curved portion.

3. The hot water device according to claim 1, wherein a boundary region between the corner flange portion and the non-corner flange portion is an inclined region, and the more the inclined region approaches the corner flange portion, the less a protrusion dimension towards the outside of the first case and the second case.

4. The hot water device according to claim 1, wherein the heat exchanger is a primary heat exchanger which collects heat from a heating gas, and the apparatus to be connected to is a secondary heat exchanger which further collects heat from a heating gas that has passed through the primary heat exchanger.

* * * * *